US009960547B1

(12) United States Patent
Hetrick et al.

(10) Patent No.: US 9,960,547 B1
(45) Date of Patent: May 1, 2018

(54) PASS-THRU CONNECTOR ASSEMBLY AND APPARATUS HAVING THE SAME

(71) Applicant: TYCO ELECTRONICS CORPORATION, Berwyn, PA (US)

(72) Inventors: Ryan David Hetrick, Carlisle, PA (US); Kenneth Wade Long, Jr., Walnut Cove, NC (US); Kevin John Peterson, Kernersville, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days. days.

(21) Appl. No.: 15/291,366

(22) Filed: Oct. 12, 2016

(51) Int. Cl.
*H01R 13/40* (2006.01)
*H01R 13/74* (2006.01)
*H01R 13/52* (2006.01)

(52) U.S. Cl.
CPC ..... *H01R 13/745* (2013.01); *H01R 13/5205* (2013.01); *H01R 2201/26* (2013.01)

(58) Field of Classification Search
CPC ..... H01R 13/5219; H01R 13/5202; H01R 23/7026; H01R 13/5208; H01R 13/4223; H01R 13/4362
USPC ..... 439/271, 559, 567, 587, 752, 595
See application file for complete search history.

(56) References Cited

U.S. PATENT DOCUMENTS 5,520,553 A * 5/1996 Cecil, Jr. ..... H01R 13/4365 439/595
6,203,348 B1 * 3/2001 Fukuda ..... H01R 13/5208 439/271
6,361,341 B1 * 3/2002 Okayasu ..... H01R 13/5216 439/271
6,361,378 B1 3/2002 Konoya et al.
6,494,731 B1 * 12/2002 Suzuki ..... H01R 13/5208 439/275
6,521,160 B2 * 2/2003 Suzuki ..... H01R 13/5205 264/267
6,659,797 B2 * 12/2003 Ichio ..... H01R 13/4361 439/595

(Continued)

FOREIGN PATENT DOCUMENTS

DE 102014102745 A1 9/2015
WO 2011097007 A1 8/2011

OTHER PUBLICATIONS

International Search Report, International Application No. PCT/IB2017/056233, International Filing Date Oct. 9, 2017.

*Primary Examiner* — Thanh Tam Le

(57) ABSTRACT

Pass-thru connector assembly includes a pass-thru body having a passage section and a loading section that are configured to be positioned in separate first and second spaces, respectively. The pass-thru body also includes a body channel that extends therethrough. The passage section defines an opening to the body channel in the first space. The pass-thru connector assembly also includes a header housing that is configured to mate with an electrical connector. The header housing is attached to the passage section and covers the opening to the body channel. An electrical cable extends through an aperture of a cable seal and into and through the cable portion of the body channel. The cable seal engages the outer jacket of the electrical cable at a sealed interface. The electrical contact is coupled to the header housing and positioned for engaging a corresponding contact of the electrical connector.

20 Claims, 5 Drawing Sheets

(56) References Cited

U.S. PATENT DOCUMENTS

| | | | | |
|---|---|---|---|---|
| 6,786,768 | B2 * | 9/2004 | Murakami | H01R 13/4365 439/271 |
| 7,001,215 | B2 * | 2/2006 | Nakamura | H01R 13/4364 439/598 |
| 7,476,133 | B2 * | 1/2009 | Tanaka | H01R 13/4364 439/752 |
| 7,575,463 | B2 * | 8/2009 | Mase | H01R 13/631 439/352 |
| 7,682,191 | B2 * | 3/2010 | Iwahori | H01R 13/4365 439/595 |
| 8,419,485 | B2 | 4/2013 | Stausser et al. | |
| 2016/0118742 | A1 | 4/2016 | Akagi et al. | |

* cited by examiner

PASS-THRU CONNECTOR ASSEMBLY AND APPARATUS HAVING THE SAME

BACKGROUND

The subject matter herein relates generally to an electrical connector assembly that provides one or more electrical pathways through a wall that separates two spaces while impeding leakage of fluid between the two spaces.

Electrical connectors may be used to transfer data and/or electrical power between different systems or devices. Electrical connectors are often designed to operate in challenging environments where contaminants, shock, and/or vibration can disrupt the electrical connection. For example, automobiles and other machinery utilize electrical connectors to communicate data and/or electrical power therein. At least some known electrical connector assemblies are configured to provide one or more electrical pathways through a wall that separates two spaces. For example, the wall may separate fluids within a transmission case of an automobile or other machinery. Such connector assemblies, which are hereinafter referred to as pass-thru connector assemblies, extend through an opening in the wall. The pass-thru connector assembly is not only designed to operate in challenging environments but is also designed to impede leakage through the pass-thru connector assembly itself or through an interface between the pass-thru connector assembly and the wall.

Conventional pass-thru connector assemblies may be manufactured by overmolding a leadframe of electrical contacts. The electrical contacts extend through a housing that was formed during the overmolding process. Mating segments of the electrical contacts project from one side of the housing and are configured to engage other contacts of a mating connector. Trailing segments of the electrical contacts project from another side of the housing and are terminated to wires. Although such pass-thru connector assemblies are effective for their intended applications, the manufacturing process can be costly and/or time-consuming.

Accordingly, there is a need for a pass-thru connector assembly that may be manufactured through a process that is less costly or time-consuming than known manufacturing methods.

BRIEF DESCRIPTION

In an embodiment, a pass-thru connector assembly is provided that includes an electrical cable having a wire conductor and an electrical contact terminated to an end of the wire conductor. The electrical cable has an outer jacket. The pass-thru connector assembly also includes a pass-thru body having a passage section and a loading section that are configured to be positioned in separate first and second spaces, respectively. The pass-thru body also includes a body channel that extends therethrough. The passage section defines an opening to the body channel in the first space, the pass-thru body having a cable seal in the body channel that separates a cable portion of the body channel from the second space. The cable seal has an aperture therethrough. The pass-thru connector assembly also includes a header housing that is configured to mate with an electrical connector. The header housing is attached to the passage section and covers the opening to the body channel. The electrical cable extends through the aperture of the cable seal and into and through the cable portion of the body channel. The cable seal engages the outer jacket of the electrical cable at a sealed interface. The electrical contact is coupled to the header housing and positioned for engaging a corresponding contact of the electrical connector.

In some embodiments, the passage section has an elongated neck that includes the opening of the body channel at a distal end of the neck. Optionally, the elongated neck and the header housing form a pluggable engagement between each other.

In some embodiments, the header housing includes an insert section that receives the electrical cable. The insert section may be disposed within the body channel. Optionally, the header housing has a blocking surface disposed in the housing cavity that engages the electrical contact and impedes withdrawal of the electrical contact through the insert section.

In some embodiments, a frictional engagement is formed at the sealed interface that holds the electrical cable in an essentially fixed position within the cable portion of the body channel during operation. The pass-thru connector assembly may be devoid of a frictional engagement between the sealed interface and the end of the wire conductor.

In some embodiments, the pass-thru body includes a base section positioned generally between the loading section and the passage section. The base section may include a flange portion that is configured to engage a wall.

In some embodiments, the pass-thru body has an interior surface that is shaped to form a positive stop. The positive stop prevents the header housing from moving closer toward the cable seal.

In some embodiments, the pass-thru connector assembly also includes an outer sealing band that surrounds the pass-thru body.

In some embodiments, the pass-thru body includes a main housing and the cable seal. The main housing includes the body channel and the opening to the body channel.

In some embodiments, the electrical contact includes a terminating segment that is mechanically and electrically coupled to the wire conductor. The electrical contact also includes a mating segment that is exposed for engaging the corresponding contact. The mating segment may be pin-shaped or blade-shaped.

In some embodiments, the electrical cable is a first electrical cable. The pass-thru connector assembly also includes a second electrical cable. The second electrical cable extends through a different aperture of the cable seal and into and through the cable portion of the body channel. The cable seal engages an outer jacket of the second electrical cable at a corresponding sealed interface.

In some embodiments, the pass-thru body includes a base section positioned generally between the loading section and the passage section. The passage section may have an elongated neck that has the opening to the body channel. The pass-thru body may also include a support rib that extends between and joins the base section and the passage section.

In an embodiment, an apparatus is provided that includes a partition wall separating first and second spaces that are configured to hold respective fluids. The partition wall has a wall opening therethrough. The apparatus also includes a pass-thru connector assembly extending through the wall opening of the partition wall. The pass-thru connector assembly and the partition wall define a first sealed interface therebetween. The pass-thru connector assembly includes a pass-thru body having a passage section and a loading section that are positioned in the first and second spaces, respectively. The pass-thru body includes a body channel that extends therethrough. The passage section defines an opening to the body channel in the first space. The pass-thru body has a cable seal in the body channel that separates a cable portion of the body channel from the second space. The cable seal has an aperture therethrough. The pass-thru connector assembly also includes an electrical cable having a wire conductor and an electrical contact terminated to an end of the wire conductor. The electrical cable extends through the aperture of the cable seal and into and through the cable portion of the body channel. The cable seal forms a second sealed interface with an outer jacket of the electrical cable. The pass-thru connector assembly also includes a header housing configured to mate with an electrical connector. The header housing is attached to the passage section and covers the opening to the body channel. The electrical contact is coupled to the header housing and positioned for engaging a corresponding contact of the electrical connector.

DETAILED DESCRIPTION

Figure 1:
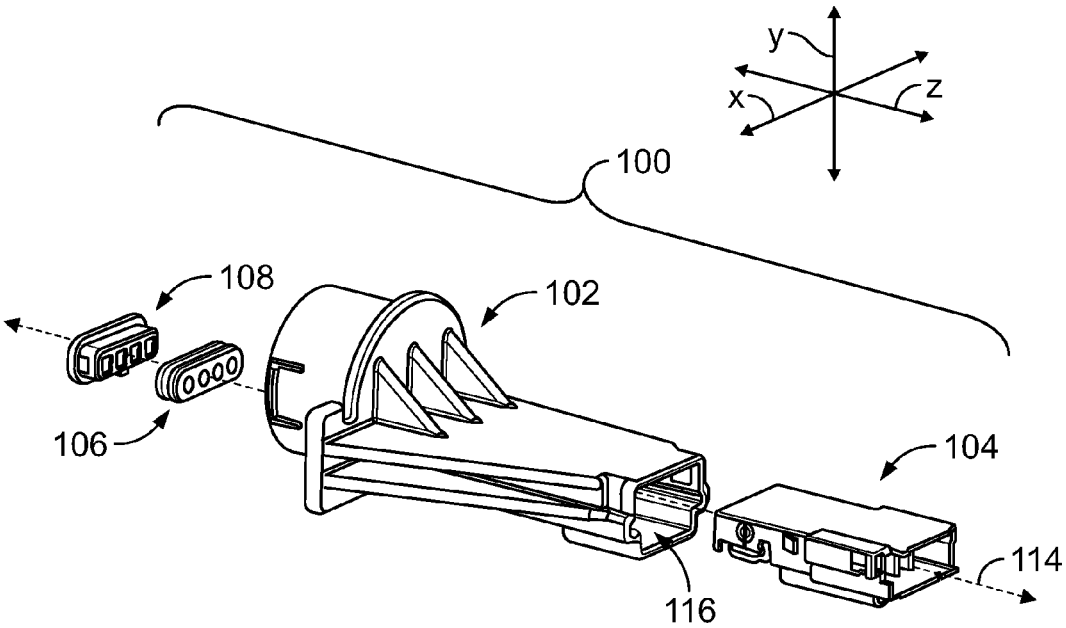
FIG. 1 is an exploded view of a pass-thru connector assembly in accordance with an embodiment.

FIG. 1 is an exploded view of a pass-thru connector assembly 100 formed in accordance with an embodiment. In the illustrated embodiment, the connector assembly 100 includes a pass-thru body 102, a header housing 104, a cable seal 106, and a seal cover 108. As shown, each of the pass-thru body 102, the header housing 104, the cable seal 106, and the seal cover 108 are discrete elements that are configured to couple to one another to form the connector assembly 100. In other embodiments, however, one or more of the elements may be combined. For example, the cable seal 106 and the seal cover 108 may be combined by molding a single unitary body to include the features of the cable seal 106 and the seal cover 108 described herein. This unitary body may then be coupled to the pass-thru body 102. As another example, the cable seal 106, the seal cover 108, and the pass-thru body 102 may be combined by molding a single unitary body that includes the features described herein.

Figure 5:
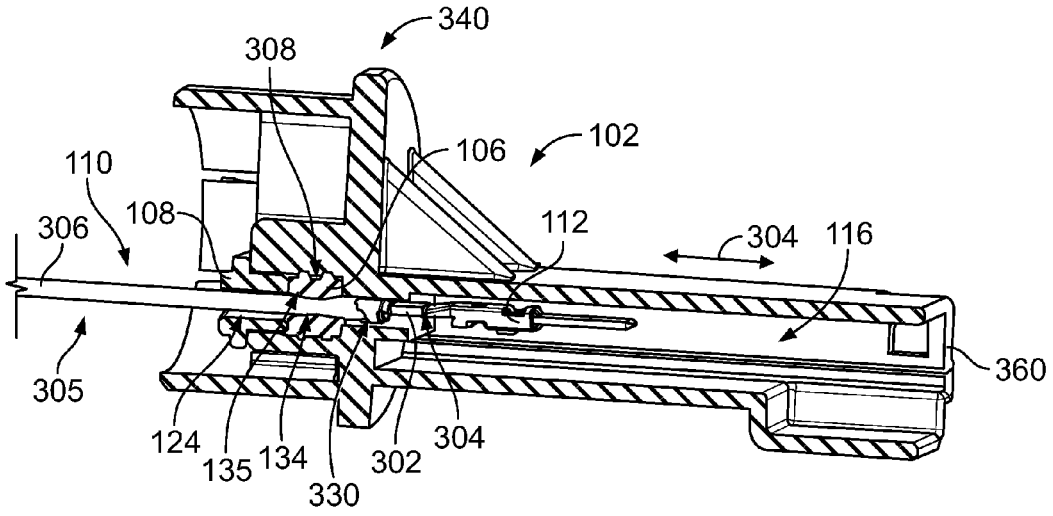
FIG. 5 is a perspective sectional view of the pass-thru connector assembly of FIG. 1 during an assembly stage.

The connector assembly 100 also includes an electrical cable 110 (shown in FIG. 5). The pass-thru body 102 includes a body channel 116 that extends through the pass-thru body 102. When the pass-thru connector assembly 100 is fully constructed, the electrical cable 110 extends through the seal cover 108, the cable seal 106, and the body channel 116 of the pass-thru body 102. The header housing 104 is configured to couple to and hold an electrical contact 112 (shown in FIG. 6) in a mating position so that a corresponding contact of a mating connector (not shown) may engage the electrical contact 112.

Figure 8:
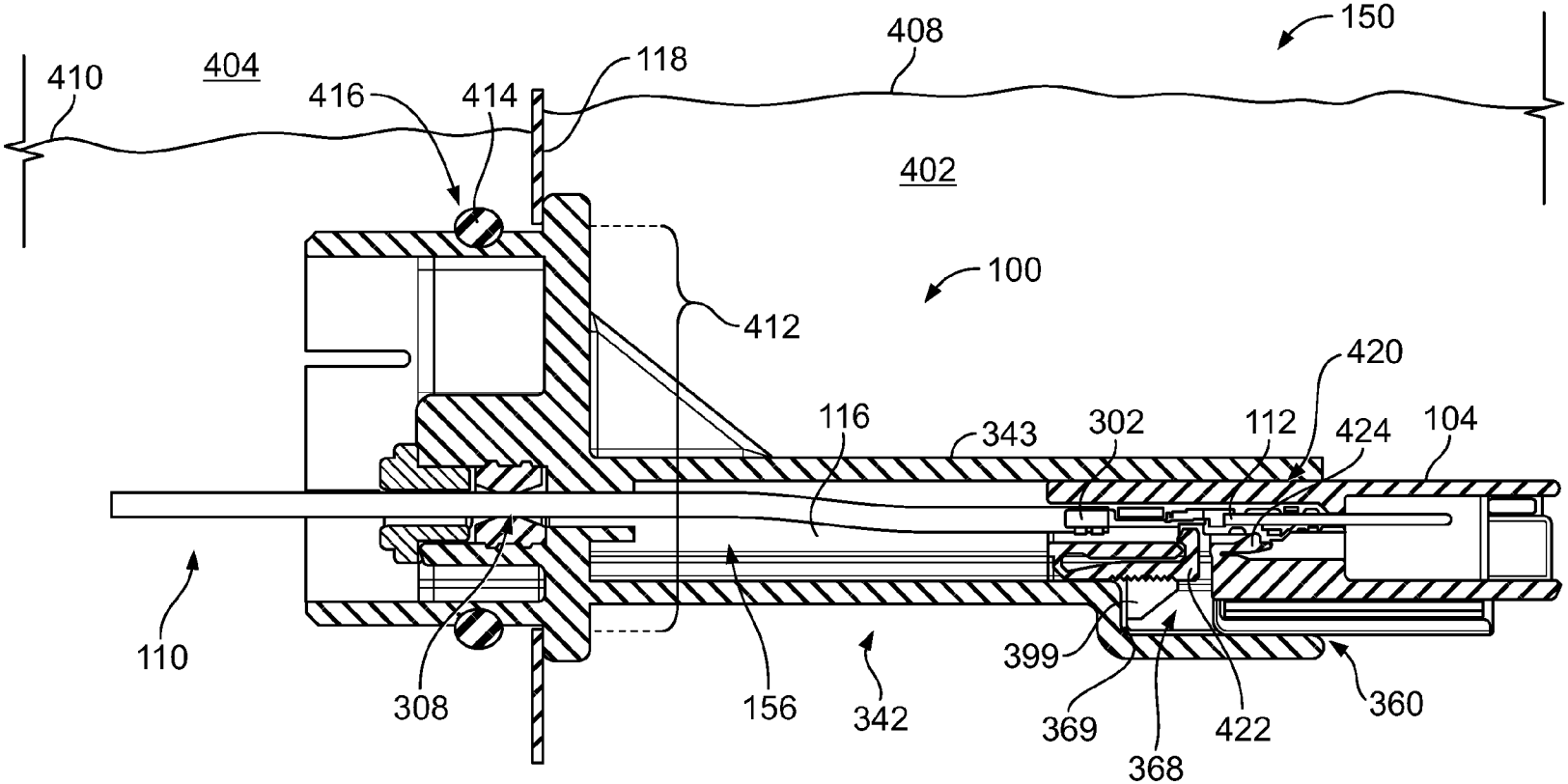
FIG. 8 is a side cross-section of the pass-thru connector assembly of FIG. 1 when fully assembled and in an operable state.

In operation, the pass-thru connector assembly 100 is configured to provide a passage for an electrical pathway through a partition wall 118 (shown in FIG. 8) of an apparatus 150 (shown in FIG. 8). The apparatus 150 may be, for example, a transmission case that houses one or more fluids (e.g., gas and/or liquids). The wall 118 may separate the fluid(s). The wall 118 may be part of, for example, a bulkhead of the transmission case. However, it should be understood that the wall 118 may be part of a variety of apparatuses that separate spaces.

As shown, the pass-thru connector assembly 100 is oriented with respect to mutually perpendicular X, Y, and Z axes. The pass-thru body 102, the header housing 104, the cable seal 106, and the seal cover 108 are configured to be generally aligned along a longitudinal axis 114 such that these elements are stacked along the longitudinal axis 114. As such, the elements of the pass-thru connector assembly 100 may be characterized as being in-line with one another. As described below, however, one more of the elements may not be stacked in-line in other embodiments.

Figure 2:
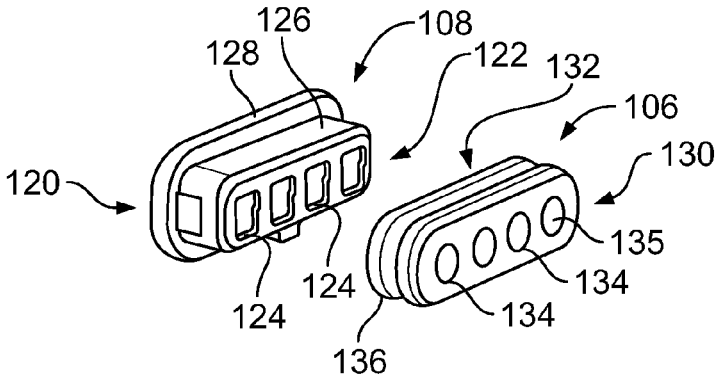
FIG. 2 is a perspective view of a seal cover and a cable seal that may be used with the pass-thru connector assembly of FIG. 1.

FIG. 2 is a perspective isolated view of the seal cover 108 and the cable seal 106 (FIG. 1). The seal cover 108 and the cable seal 106 are configured to hold the electrical cables 110 (FIG. 5) during assembly and, after the assembly process, prevent fluid from passing therethrough. To this end, the seal cover 108 and the cable seal 106 are configured to couple to the pass-thru body 102 (FIG. 1) and block one end of the body channel 116 (FIG. 1). In the illustrated embodiment, the seal cover 108 and the cable seal 106 are discrete components with respect to each other and the pass-thru body 102. In other embodiments, the seal cover 108 and the cable seal 106 may be combined to form a unitary piece. Yet in other embodiments, the pass-thru body 102 may be molded to include the features of the seal cover 108 and the cable seal 106. In such embodiments, the pass-thru body 102 may include the functional features of the cable seal 106 and the seal cover 108.

The seal cover 108 includes an outer side 120, an inner side 122, and a plurality of apertures or ports 124 that extend between the outer side 120 and the inner side 122. The seal cover 108 has a plug section 126 that includes the inner side 122 and an outer section (or cap section) 128 that includes the outer side 120. The plug section 126 is sized and shaped to be inserted into a recess of the pass-thru body 102 (FIG. 1), such as the seal portion 258 (FIG. 3).

The cable seal 106 is sized and shaped to be positioned within the recess of the pass-thru body 102. The cable seal 106 includes a first side 130, a second side 132, and a plurality of apertures or ports 134 that extend between the first side 130 and the second side 132. The apertures 134 are configured to align with the apertures 124 of the seal cover 108. The apertures 134 are defined by interior surfaces 135 that are configured to engage and grip respective electrical cables 110 (FIG. 5) to prevent leakage of fluids through the apertures 134. Likewise, the cable seal 106 may include one or more ridges 136 that project outwardly from a main body of the cable seal 106. The ridges 136 are sized and shaped to engage an interior surface of the pass-thru body 102 to prevent leakage of the fluids therethrough.

In the illustrated embodiment, the seal cover 108 includes four (4) apertures 124 and the cable seal 106 includes four (4) apertures 134. It should be understood, however, that the seal cover 108 and the cable seal 106 may each include a different number of apertures 124. For example, each of the seal cover 108 and the cable seal 106 may include only a single corresponding aperture, two corresponding apertures, three corresponding apertures, or more than four corresponding apertures.

Figure 3:
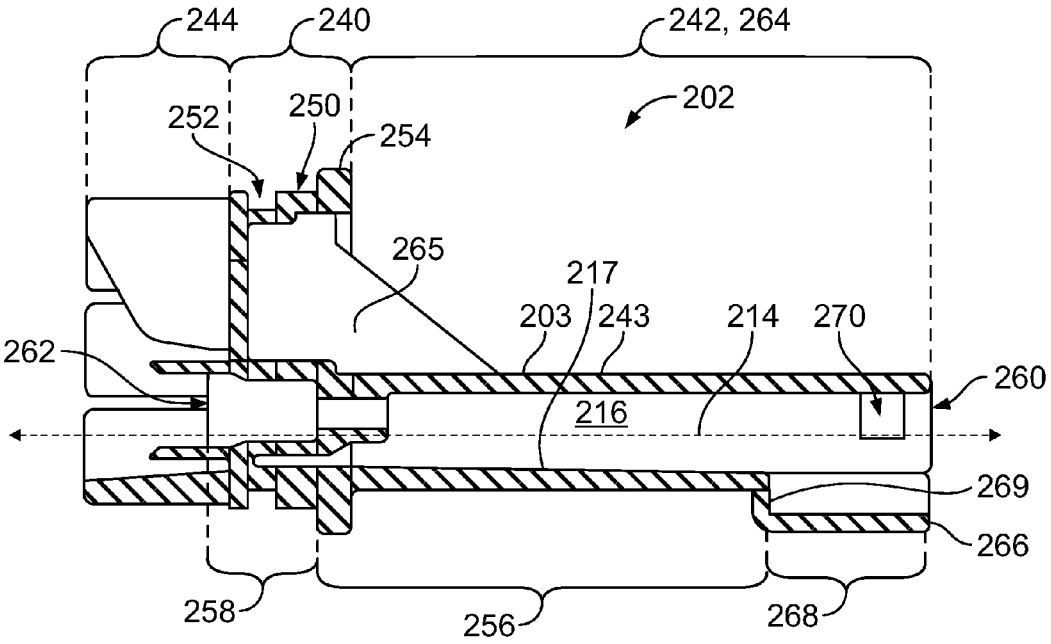
FIG. 3 is a cross-section of a pass-thru body that may be used with the pass-thru connector assembly of FIG. 1.

FIG. 3 is a cross-section of a pass-thru body 202, which may have features that are similar or identical to the features of the pass-thru body 102 (FIG. 1). In some embodiments, the pass-thru body 202 may replace the pass-thru body 102 in the connector assembly 100 (FIG. 1). Accordingly, the following description of the pass-thru body 202 may be similarly applied to the pass-thru body 102.

In the illustrated embodiment, the pass-thru body 202 includes a base section 240, a passage section 242, and a loading section 244. For embodiments in which the cable seal and seal cover are discrete with respect to a remainder of the pass-thru body 202, the remainder may be referred to as a main housing 203. A longitudinal axis 214 extends through a body channel 216 of the pass-thru body 202. The base section 240 is positioned generally between the passage section 242 and the loading section 244. The base section 240 is configure to engage or interface with a wall (not shown) through which the pass-thru body 202 extends. The wall may be similar to the wall 118 (FIG. 8). The base section 240 includes an outer surface 250 that faces radially away from the longitudinal axis 214. The outer surface 250 is shaped to engage a sealing band (not shown) that extends around (or surrounds) the pass-thru body 202. Optionally, the outer surface 250 may be shaped to define a band channel 252 that is sized and shaped to receive the sealing band.

The base section 240 may also form a flange or rim portion 254 that extends radially away. The flange portion 254 may have a profile that is greater than a profile of a hole through which the pass-thru body 202 extends. More specifically, the flange portion 254 may be sized to prevent the pass-thru body 202 from being inserted entirely through the hole of the wall.

The passage section 242 and the loading section 244 are configured to be positioned in separate first and second spaces, respectively. The body channel 216 extends through the pass-thru body 202. The body channel 216 includes a cable portion 256 and a seal portion 258. The cable portion 256 extends through the passage section 242. The seal portion 258 represents the portion of the body channel 216 that receives a cable seal and a seal cover (not shown), which may be similar to the cable seal 106 and the seal cover 108 (FIG. 1), respectively. The cable seal may separate the cable portion 256 from the space along the loading section 244. In the illustrated embodiment, the seal portion 258 is a recess of the body channel 216 that opens along the loading section 244 to the respective space. The seal portion 258 exists within the base section 240 and the loading section 244. In other embodiments, however, the seal portion 258 may have a shallower depth and exist only within the loading section 244, or the seal portion 258 may have a greater depth and exist within the passage section 242. The loading section 244 defines an opening 262 to the body channel 216.

The passage section 242 defines an opening 260 to the body channel 216. In the illustrated embodiment, the passage section 242 includes an elongated neck or nozzle 243 that extends a distance 264 along the longitudinal axis 214 from the base section 240 to a distal end. The elongated neck 243 includes the opening 260 at the distal end. The distance 264 may be, for example, at least one (1) centimeter (cm), at least two (2) cm, or at least three (3) cm. In some embodiments, the distance 264 may be, for example, at least four (4) cm, at least five (5) cm, or at least six (6) cm. In particular embodiments, the distance 264 is less than ten (10) cm. In some embodiments, the passage section 242 includes support ribs or walls 265 that extend from the base section 240 in a direction toward a mid-portion of the neck 243 or the opening 260. The support ribs 265 engage the neck 243 and may support the neck 243 in a designated position.

The opening 260 is defined by a distal edge 266. The distal edge 266 is configured to engage a header housing 204 (shown in FIG. 4) or the header housing 104 (FIG. 1). In the illustrated embodiment, the body channel 216 is configured to receive at least a portion of the header housing 204. To this end, the body channel 216 may include a header portion 268 that is configured to receive the header housing 204. An interior surface 217 of the passage section 256 that defines body channel 216 may be shaped to form a positive stop 269. The positive stop 269 may engage the header housing 204 and prevent the header housing 204 from moving closer to the cable seal. Also shown, the passage section 242 may include a side opening 270 that is sized and shaped to receive a portion of the header housing 204.

Figure 4:
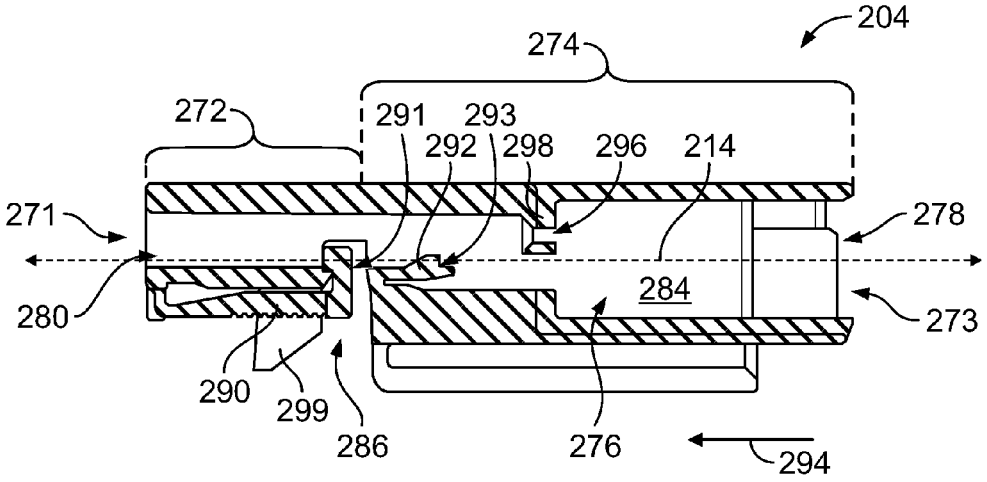
FIG. 4 is a cross-section of a header housing that may be used with the pass-thru connector assembly of FIG. 1.

FIG. 4 is a cross-section of the header housing 204 that is configured to be attached to the pass-thru body 202 (FIG. 3) or the main housing 203 (FIG. 3). The header housing 204 may be similar or identical to the header housing 104 (FIG. 1) and replace the header housing 104 in the pass-thru connector assembly 100. The header housing 204 has a back end 271 and a front end 273 and a housing cavity 276 that extends therebetween. In the illustrated embodiment, the header housing 204 is shaped to include an insert section 272 having the back end 271 and a mating section 274 having the front end 273. The housing cavity 276 extends through the insert section 272 and the mating section 274. The housing cavity 276 has a front opening 278 at the front end 273 of the mating section 274 and a rear opening 280 at the back end 271 of the insert section 272. The insert section 272 may include a projection or shoe 299 that engages the positive stop 269 (FIG. 3). When the header housing 204 is operably positioned, the longitudinal axis 214 extends between the front and rear openings 278, 280 through the housing cavity 276.

In the illustrated embodiment, the housing cavity 276 includes a receiving portion 284. Electrical contacts (not shown) are configured to be exposed within the receiving portion 284 for engaging the mating connector (not shown). The receiving portion 284 is sized and shaped to receive the mating connector and form a pluggable engagement. In other embodiments, however, the housing cavity 276 does not receive the mating connector. In such embodiments, the electrical contacts may clear the front end 273.

The electrical contacts are configured to be inserted through the rear opening 280. The header housing 204 may include a self-locking mechanism 286 that includes one or more blocking surfaces that prevent withdrawal of the electrical contacts after the electrical contacts have been operably positioned. For example, the insert section 272 includes a first latch 290 and the mating section 274 includes a second latch 292. Each of the first and second latches 290, 292 is configured to be deflected by one or more of the electrical contacts. Each of the first and second latches 290, 292 may be biased or predisposed to flex back toward an undeflected position after the electrical contact clears the respective latch.

The first and second latches 290, 292 include blocking surfaces 291, 293, respectively. When the electrical contacts are operably positioned, the blocking surfaces 291, 293 are positioned to engage the electrical contacts. For example, if the electrical contacts (or corresponding electrical cables)

are moved in a withdrawal direction 294 along the longitudinal axis 214, the blocking surfaces 291, 293 may engage the electrical contacts and impede withdrawal.

Also shown in FIG. 4, the mating section 274 may also include a contact aperture 296 that is sized and shaped to receive a mating segment (not shown) of a corresponding electrical contact. For example, the mating segment of the corresponding electrical contact may be pin-shaped or blade-shaped and configured to be inserted through the aperture 296 and into the receiving portion 284 of the housing cavity 276. The interior surfaces that define the aperture 296 may prevent movement of the mating segment in a direction that is transverse to the longitudinal axis 214. The blocking surfaces 291, 293 may impede movement of the electrical contacts in the withdrawal direction 294. An interior wall 298 of the header housing 204 that includes the aperture 296 may prevent the electrical contacts from moving in a direction that is opposite the withdrawal direction 294. As such, the electrical contacts may be held in essentially fixed positions during operation.

FIG. 5 is a perspective sectional view of the pass-thru connector assembly 100 during an assembly stage. The electrical cable 110 includes a wire conductor 302 and the electrical contact 112 terminated to an end 304 of the wire conductor 302. In the illustrated embodiment, the electrical cable 110 has an outer jacket 306. In some embodiments, the electrical cable 110 may include an insulated wire 305 having the outer jacket 306 and the wire conductor 302. The outer jacket 306, in this example, may be the insulation layer that surrounds the wire conductor 302. In other embodiments, however, the outer jacket 306 may surround multiple insulated wires.

Prior to the assembly stage shown in FIG. 5, each of the wire conductors 302 and respective outer jacket 306 is inserted through one of the apertures 124 and one of the apertures 134 of the seal cover 108 and the cable seal 106, respectively. For example, each insulated wire 305 may be inserted through corresponding apertures 124, 134. The cable seal 106 engages the outer jacket 306 at a sealed interface 308. The sealed interface 308 may form a frictional engagement between the interior surface 135 and the outer jacket 306. More specifically, the cable seal 106 may exert a radially-inward force (or compressive force) against the outer jacket 306 thereby generating friction between the cable seal 106 and the outer jacket 306. As such, a longitudinal force in either direction (as indicated by the bi-directional arrow 309) is required to move the outer jacket 306 and corresponding wire conductor 302 through the aperture 134. After the outer jacket 306 and corresponding wire conductor 302 are advanced through the aperture 134, the electrical contact 112 may be terminated to the insulated wire 305. However, it should be understood that other methods of manufacturing may be used. For example, the electrical contact 112 may be terminated to the insulated wire 204 prior to being inserted into the seal cover 108 in other embodiments.

Figure 6:
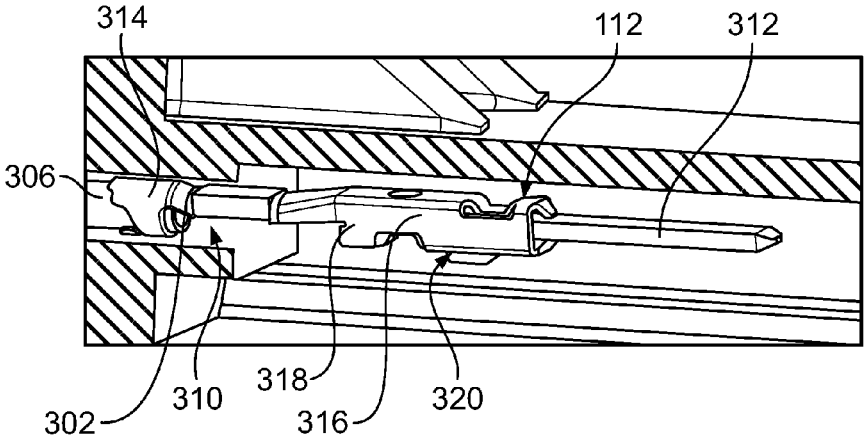
FIG. 6 is an enlarged view of the pass-thru connector assembly illustrating an electrical contact in greater detail.

FIG. 6 illustrates an exemplary electrical contact 112 in greater detail. In particular embodiments, the electrical contact 112 is a crimp contact, but other electrical contacts are contemplated. As shown, the electrical contact 112 includes a terminating segment 310 and a mating segment 312. The mating segment 312 may be pin-shaped or blade-shaped and is configured to engage a corresponding contact of an electrical connector. The terminating segment 310 is configured to mechanically and electrically engage the wire conductor 302. For example, the terminating segment 310 may form a crimp tab 314 that is configured to be mechanically deformed to grip, for example, wire strands that form the wire conductor 302. Alternatively, the crimp tab 314 may be deformed to grip the outer jacket 306 and other portions of the terminating segment 310 may electrically couple to the wire conductor 302.

The electrical contact 310 also includes an intermediate segment 316. The intermediate segment 316 is shaped to include first and second engagement surfaces 318, 320 that are configured to engage first and second latches 422, 424 (shown in FIG. 8) of the header housing 104 (FIG. 1).

Returning to FIG. 5, after the electrical contacts 112 are mechanically and electrically coupled to the corresponding insulated wires 305, the electrical contacts 112 may be inserted through apertures 330 of the pass-thru body 102. The apertures 330 are configured to align with the apertures 124, 134 and may extend through a base section 340 of the pass-thru body 102. The electrical cables 110 may then be advanced through the body channel 116 until the electrical contacts 112 clear an opening 360 of the body channel 116.

Figure 7:
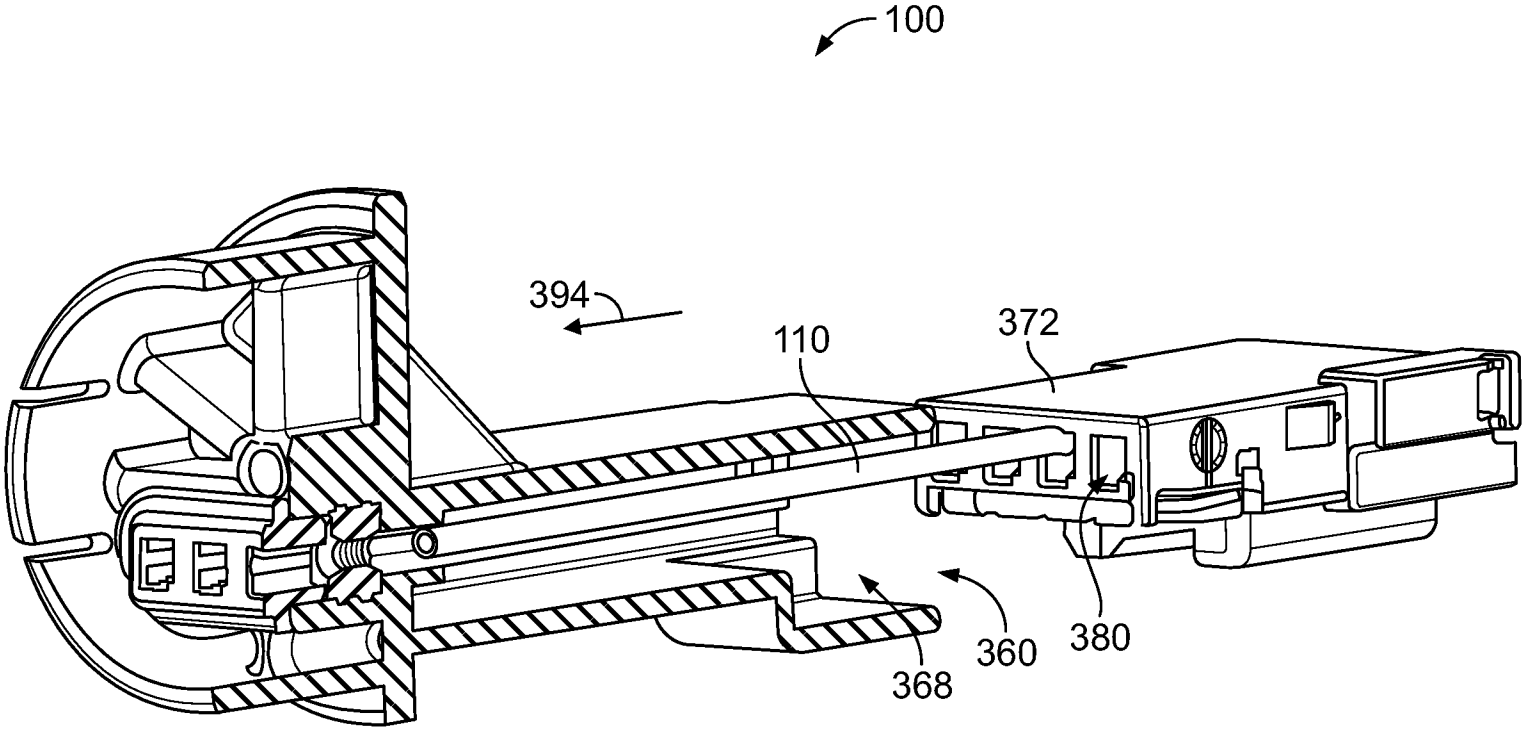
FIG. 7 is a perspective sectional view of the pass-thru connector assembly of FIG. 1 during an assembly stage.

FIG. 7 is a perspective sectional view of the pass-thru connector assembly 100 during another assembly stage. After the electrical contacts 112 (FIG. 6) of the electrical cables 110 clear the opening 360, the electrical contacts 112 are inserted through respective rear openings 380 of the header housing 104. As described below, the electrical contacts 112 may operably engage first and second latches 422, 424 (FIG. 8) of the header housing 104. After the electrical contacts 112 are secured within the header housing 104, the electrical cables 110 may be pulled in a withdrawal direction 394 and an insert section 372 of the header housing 104 may be inserted into a header portion 368 of the body channel 116.

FIG. 8 is a side cross-section of an apparatus 150 in accordance with an embodiment. As shown, the apparatus 150 includes the partition wall 118 that separates first and second spaces 402, 404 that are configured to hold fluids 408, 410, respectively. In some embodiments, the fluids 408, 410 have the same composition. In other embodiments, however, the fluids 408, 410 may have different compositions. The partition wall 118 has a wall opening 412 therethrough. The pass-thru connector assembly 100 is coupled to the partition wall 118 and extends through the wall opening 412.

The pass-thru connector assembly 100 is in an operable position in FIG. 8. As shown, the header housing 104 is positioned within the header portion 368 of the body channel 116. A positive stop 369 within the body channel 116 is engaged with a shoe 399 of the header housing 104. The positive stop 369 prevents the header housing 104 from moving closer to the cable seal 106. In the operable position, the header housing 104 and a passage section 342 of the pass-thru body 102 form a pluggable engagement. The pluggable engagement may also form a sealed interface 420 that prevents leakage into a cable portion 156. For example, the passage section 342 may be similar to a sleeve that surrounds at least a portion of the header housing 104. In alternative embodiments, the header housing 104 may surround the passage section 342 and form a pluggable engagement therewith. In the illustrated embodiment, the passage section 342 includes an elongated neck 343 that is similar to the elongated neck 243. The elongated neck 343 is essentially linear in FIG. 8. In other embodiments, the elongated neck 343 may be non-linear. For instance, the elongated neck 343 may have a curved contour.

While in the operable position, the electrical cable 110 extends through the cable portion 156 of the body channel 116. A frictional engagement is formed at the sealed interface 308 that holds the electrical cable 110 in an essentially fixed position within the cable portion 156 during operation. The header housing 104 includes first and second latches 422, 424 that hold the electrical contact 112 in an essentially fixed position within a housing cavity 426 of the header housing 104. In some embodiments, the pass-thru connector assembly 100 is devoid of other frictional engagements between the sealed interface 308 and the end of the wire conductor 302. In such embodiments, slack in the electrical cable 110 may exist within the cable portion 156 so that strain or other unwanted forces are not continuously exerted at the interface between the wire conductor 302 and the electrical contact 112.

The sealed interface 308 is a first sealed interface. In the illustrated embodiment, a sealing band 414 may surround the pass-thru body 102. The sealing band 414 may engage the partition wall 118 or other component of the apparatus to form a second sealed interface 416. The sealed interface 420 may be a third sealed interface. Additional sealed interfaces may exist.

The passage section 342 is positioned in the first space 402, and the pass-thru body 102 has a loading section 344 that is positioned in the second space 404. The body channel 116 extends through the pass-thru body 102. The header housing 104 is attached to the passage section 342 and covers the opening 360 to the body channel 116. The electrical contact 112 is coupled to the header housing 104 and is positioned for engaging a corresponding contact of the electrical connector (not shown).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A pass-thru connector assembly comprising:

an electrical cable including a wire conductor and an electrical contact terminated to an end of the wire conductor, the electrical cable having an outer jacket;

a pass-thru body having a passage section and a loading section that are configured to be positioned in separate first and second spaces, respectively, the pass-thru body also includes a body channel that extends therethrough, the passage section defining an opening to the body channel in the first space, the pass-thru body having a cable seal in the body channel that separates a cable portion of the body channel from the second space, the cable seal having an aperture therethrough; and a header housing configured to mate with an electrical connector, the header housing being attached to the passage section and covering the opening to the body channel, wherein the electrical cable extends through the aperture of the cable seal and into and through the cable portion of the body channel, the cable seal engaging the outer jacket of the electrical cable at a sealed interface, the electrical contact being coupled to the header housing and positioned for engaging a corresponding contact of the electrical connector, wherein the header housing includes a housing cavity having an interior surface and a latch disposed therein, the latch configured to be deflected by the electrical contact and having a blocking surface, the electrical contact being secured within the header housing such that the blocking surface prevents the electrical contact from being withdrawn in a rearward direction with respect to the header housing and the interior surface prevents the electrical contact from moving in a forward direction with respect to the header housing, wherein the sealed interface permits the electrical cable to slide through the aperture when a longitudinal force is applied in the rearward direction, the sealed interface permitting the electrical cable to slide through the aperture in the rearward direction after the electrical contact is terminated to the wire conductor and secured within the header housing.

2. The pass-thru connector assembly of claim 1, wherein the passage section includes an elongated neck that includes the opening of the body channel at a distal end of the neck, wherein a length of the electrical cable extending through the cable portion between the cable seal and the header housing is greater than a distance between the cable seal and the header housing.

3. The pass-thru connector assembly of claim 2, wherein the elongated neck and the header housing form a pluggable engagement between each other, the elongated neck extending at least five centimeters from the cable seal to the distal end of the neck.

4. The pass-thru connector assembly of claim 1, wherein the header housing includes an insert section that receives the electrical cable, the insert section being disposed within the body channel.

5. The pass-thru connector assembly of claim 1, wherein the header housing includes an insert section, a mating section, and a housing cavity extending therethrough, the insert section configured to receive the electrical cable.

6. The pass-thru connector assembly of claim 1, wherein the pass-thru body includes a base section positioned generally between the loading section and the passage section, the base section including a flange portion that is configured to engage a wall.

7. The pass-thru connector assembly of claim 1, wherein the pass-thru body has an interior surface that is shaped to form a positive stop, the positive stop preventing the header housing from moving closer toward the cable seal.

8. The pass-thru connector assembly of claim 1, further comprising an outer sealing band that surrounds the pass-thru body.

9. The pass-thru connector assembly of claim 1, wherein the pass-thru body includes a main housing and the cable seal, the main housing including the body channel and the opening to the body channel.

10. The pass-thru connector assembly of claim 1, wherein the electrical contact includes a terminating segment that is mechanically and electrically coupled to the wire conductor, the electrical contact also including a mating segment that is exposed for engaging the corresponding contact, the mating segment being pin-shaped or blade-shaped.

11. The pass-thru connector assembly of claim 1, wherein the electrical cable is a first electrical cable, the pass-thru connector assembly further comprising a second electrical cable, wherein the second electrical cable extends through a different aperture of the cable seal and into and through the cable portion of the body channel, the cable seal engaging an outer jacket of the second electrical cable at a corresponding sealed interface.

12. The pass-thru connector assembly of claim 1, wherein the pass-thru body includes a base section positioned generally between the loading section and the passage section, the passage section including an elongated neck that has the opening to the body channel, the pass-thru body also including a support rib that extends between and joins the base section and the passage section, the outer jacket of the electrical cable extending from the sealed interface toward the header housing and being exposed within the cable portion of the body channel in the elongated neck.

13. A pass-thru connector assembly comprising:

an electrical cable including a wire conductor and an electrical contact terminated to an end of the wire conductor, the electrical cable having an outer jacket;

a pass-thru body having a passage section and a loading section that are configured to be positioned in separate first and second spaces, respectively, the pass-thru body also includes a body channel that extends therethrough, the passage section defining an opening to the body channel in the first space, the pass-thru body having a cable seal in the body channel that separates a cable portion of the body channel from the second space, the cable seal having an aperture therethrough; and a header housing configured to mate with an electrical connector, the header housing being attached to the passage section and covering the opening to the body channel, wherein the electrical cable extends through the aperture of the cable seal and into and through the cable portion of the body channel, the cable seal engaging the outer jacket of the electrical cable at a sealed interface, the electrical contact being coupled to the header housing and positioned for engaging a corresponding contact of the electrical connector;

wherein a frictional engagement is formed at the sealed interface that holds the electrical cable in an essentially fixed position during operation, the pass-thru connector assembly being devoid of a frictional engagement between the sealed interface and the header housing such that slack exists within the electrical cable that extends through the cable portion of the body channel after the pass-thru connector assembly is fully constructed, the outer jacket of the electrical cable being exposed within the cable portion and extending from the sealed interface toward the header housing.

14. An apparatus comprising:

a partition wall separating first and second spaces that are configured to hold respective fluids, the partition wall having a wall opening therethrough; and a pass-thru connector assembly extending through the wall opening of the partition wall, the pass-thru connector assembly and the partition wall defining a first sealed interface therebetween, the pass-thru connector assembly comprising:

a pass-thru body having a passage section and a loading section that are positioned in the first and second spaces, respectively, the pass-thru body including a body channel that extends therethrough, the passage section defining an opening to the body channel in the first space, the pass-thru body having a cable seal in the body channel that separates a cable portion of the body channel from the second space, the cable seal having an aperture therethrough;

an electrical cable including a wire conductor and an electrical contact terminated to an end of the wire conductor, the electrical cable extending through the aperture of the cable seal and into and through the cable portion of the body channel, the cable seal forming a second sealed interface with an outer jacket of the electrical cable; and a header housing configured to mate with an electrical connector, the header housing being attached to the passage section and covering the opening to the body channel, the electrical contact being coupled to the header housing and positioned for engaging a corresponding contact of the electrical connector;

wherein the passage section of the pass-thru body includes an elongated neck that has the opening of the body channel at a distal end of the elongated neck, the elongated neck being disposed within the first space, the outer jacket of the electrical cable extending from the sealed interface toward the header housing and being exposed within the cable portion of the body channel in the elongated neck after the pass-thru connector assembly is fully constructed.

15. The apparatus of claim 14, wherein the elongated neck and the header housing form a pluggable engagement between each other.

16. The apparatus of claim 14, wherein the header housing includes an insert section that receives the electrical cable, the insert section being disposed within the body channel.

17. The apparatus of claim 14, wherein the header housing includes an insert section, a mating section, and a housing cavity extending therethrough, the insert section configured to receive the electrical cable, the header housing having a blocking surface disposed in the housing cavity that engages the electrical contact and impedes withdrawal of the electrical contact through the insert section.

18. The apparatus of claim 14, wherein a frictional engagement is formed at the second sealed interface that holds the electrical cable in an essentially fixed position during operation, the pass-thru connector assembly being devoid of a frictional engagement between the second sealed interface and the end of the wire conductor.

19. The apparatus of claim 14, wherein the pass-thru body includes a base section positioned generally between the loading section and the passage section, the base section including a flange portion that engages the partition wall.

20. The apparatus of claim 14, wherein the header housing includes a housing cavity having an interior surface and a latch disposed therein, the latch being configured to be deflected by the electrical contact and having a blocking surface, the blocking surface preventing the electrical contact from being withdrawn in a rearward direction with respect to the header housing and the interior surface preventing the electrical contact from moving in a forward direction with respect to the header housing.

* * * * *